US009174822B2

(12) United States Patent
Cortona et al.

(10) Patent No.: US 9,174,822 B2
(45) Date of Patent: Nov. 3, 2015

(54) DOUBLE-DECKER LIFT INSTALLATION

(75) Inventors: Elena Cortona, Zurich (CH); Frankie Schmid, Horw (CH)

(73) Assignee: Inventio AG, Hergiswil (CH)

( * ) Notice: Subject to any disclaimer, the term of this patent is extended or adjusted under 35 U.S.C. 154(b) by 520 days.

(21) Appl. No.: 13/516,307

(22) PCT Filed: Dec. 1, 2010

(86) PCT No.: PCT/EP2010/068594

§ 371 (c)(1),
(2), (4) Date: Jul. 2, 2012

(87) PCT Pub. No.: WO2011/082897

PCT Pub. Date: Jul. 14, 2011

(65) Prior Publication Data

US 2012/0312636 A1 Dec. 13, 2012

(30) Foreign Application Priority Data

Dec. 15, 2009 (EP) ..... 09179256

(51) Int. Cl.
*B66B 9/00* (2006.01)
*B66B 1/42* (2006.01)
*B66B 11/02* (2006.01)

(52) U.S. Cl.
CPC ..... *B66B 1/42* (2013.01); *B66B 11/022* (2013.01); *B66B 11/0206* (2013.01); *B66B 11/0213* (2013.01); *B66B 2201/306* (2013.01); *B66B 2201/307* (2013.01)

(58) Field of Classification Search
CPC B66B 11/009; B66B 11/022; B66B 11/0095; B66B 11/0213; B66B 1/40; B66B 1/42
USPC ..... 187/249, 291
See application file for complete search history.

(56) References Cited

U.S. PATENT DOCUMENTS

| | | | | | |
|---|---|---|---|---|---|
| 1,805,227 | A * | 5/1931 | Rugg | ..... | 187/249 |
| 1,996,982 | A | 2/1934 | Mepeak | | |
| 4,976,338 | A * | 12/1990 | Holland | ..... | 187/285 |
| 5,220,981 | A * | 6/1993 | Kahkipuro et al. | ..... | 187/249 |
| 5,526,901 | A * | 6/1996 | Salmon | ..... | 187/249 |
| 5,907,136 | A * | 5/1999 | Hongo et al. | ..... | 187/277 |
| 6,161,652 | A * | 12/2000 | Kostka et al. | ..... | 187/291 |
| 6,336,522 | B1 * | 1/2002 | Fujita et al. | ..... | 187/380 |
| 6,802,396 | B2 * | 10/2004 | Naitoh | ..... | 187/401 |
| 7,232,011 | B2 * | 6/2007 | Strebel et al. | ..... | 187/249 |

(Continued)

FOREIGN PATENT DOCUMENTS

| | | | | | |
|---|---|---|---|---|---|
| EP | 1357075 | A1 * | 10/2003 | ..... | B66B 11/02 |
| JP | 04223985 | A * | 8/1992 | ..... | B66B 1/40 |
| JP | 10-236753 | A | 9/1998 | | |

*Primary Examiner* — Emmanuel M Marcelo
*Assistant Examiner* — Stefan Kruer
(74) *Attorney, Agent, or Firm* — Fraser Clemens Martin & Miller LLC; William J. Clemens

(57) ABSTRACT

An elevator has an elevator car supporting frame that can travel in a travel space provided for a journey of the elevator car supporting frame. The elevator installation is also provided with a first elevator car and a second elevator car arranged on the elevator car supporting frame. Furthermore, a hydraulic moving element is arranged in a lower end region of the travel space. In this way, the first elevator car can be moved in relation to the second elevator car, by the moving device, in the lower end region of the travel space.

10 Claims, 2 Drawing Sheets

(56) References Cited

U.S. PATENT DOCUMENTS

| | | | | |
|---|---|---|---|---|
| 7,261,185 | B2 * | 8/2007 | Strebel et al. | 187/249 |
| 7,581,621 | B2 * | 9/2009 | Kontturi | 187/316 |
| 7,624,845 | B2 * | 12/2009 | Mustalahti et al. | 187/249 |
| 2005/0167207 | A1 * | 8/2005 | Fujita et al. | 187/401 |
| 2005/0217941 | A1 * | 10/2005 | Strebel et al. | 187/249 |

* cited by examiner

DOUBLE-DECKER LIFT INSTALLATION

FIELD

The invention relates to an elevator system having at least one elevator car support that can hold two or more elevator cars. The invention relates specifically to the field of elevator systems designed as so-called double-decker elevator systems.

BACKGROUND

JP 10-236753 A discloses a double-decker elevator. The known elevator has two cars which are arranged one above the other in a car frame. The two cars can hereby move relative to each other. For this purpose, hydraulic cylinders are arranged in a counterweight frame. A traction cable which is connected at one end to the counterweight frame and at the other end to the car frame is guided over a drive pulley. Moreover, a second cable in addition to the traction cable is guided over a freewheeling pulley and is connected at one end to the hydraulic cylinders and at the other end to one of the cars. When the hydraulic cylinders actuate the second cable, the cars are moved relative to each other.

The double-decker elevator known from JP 10-236753 A has the disadvantage that it has a complex design. On the one hand, the design of the counterweight frame is complex because the hydraulic cylinders move with the counterweight frame through the elevator shaft, which requires an additional control means. Moreover, a cable guide for the second cable is additionally needed. Elongation or shortening of the traction cable and the second cable, occurring during operation, are hereby also possible, which results in undesired relative movement between the two elevator cars.

SUMMARY

An object of the invention is to provide an elevator system which has an improved structure. Specifically, an object of the invention is to provide an elevator system that permits relative movement between at least two elevator cars with a relatively low degree of complexity.

The elevator system is thus with at least one elevator car support which displaceable in a travel space provided for the travel of the elevator car support. A first elevator car is arranged the on the elevator car support. At least a second elevator car is additionally arranged on the elevator car support. An adjusting device is arranged in a lower end region of the travel space, it being possible to adjust the first elevator car in the lower end region of the travel space relative to the second elevator car in the direction of travel using the adjusting device.

In the design of the elevator system, the elevator car support can be arranged in an elevator shaft that defines the travel space, a drive motor unit being provided which serves to actuate the elevator car support. As a result, the elevator car support can be displaced along the travel path provided. The elevator car support can hereby be suspended from a traction means connected to the elevator car support. The traction means can hereby be guided in a suitable fashion over a drive pulley of the drive motor unit. As well as having the function of transmitting the force or the torque from the drive motor unit to the elevator car support in order to actuate the elevator car support, the traction means can here also have the function of carrying the elevator car support. Actuation of the elevator car support is hereby understood in particular as raising or lowering the elevator car support, it being possible for the elevator car support to be guided by one or more guide rails.

It is advantageous that the first elevator car can be fixed with respect to the second elevator car, and that the first elevator car can be unfixed with respect to the second elevator car in the lower end region of the travel space. It is also hereby advantageous that the elevator car support comprises a first elevator car support part and a second elevator car support part, that the first elevator car is connected to the first elevator car support part, that the second elevator car is connected to the second elevator car support part, and that a connecting and locking device is provided which connects the first elevator car support part to the second elevator car support part in the closed state and disconnects them in the open state. In the closed state, the elevator car support with the two elevator cars can be displaced through the travel space, a constant distance being maintained between the elevator cars. For example, upper floors situated one above the other can each have the same inter-floor distance. As a result, in the closed state, people can enter and leave both elevator cars on the respective floors. A basement or a lobby may, for example, be located in the lower end region of the travel space. Disconnecting the two elevator car support parts can hereby adjust the two elevator cars relative to each other. In the open state, the first elevator car can hereby in particular be lowered and positioned. People can then enter and leave both elevator cars according to the floor to which they have moved. The first elevator car with the first elevator car support part can then be raised again. The connecting and locking device can then reconnect the two elevator car support parts.

It is hereby also advantageous that the connecting and locking device has at least one connecting element that interacts in the closed state with a connection point of the first elevator car support and/or with a connection point of the second elevator car support part. The connecting element can, for example, have a bar-like design and in the closed state be guided through bores which are formed in the elevator car support parts. In order to disconnect the elevator car support parts, the connecting element can be withdrawn from the through bores so that the open state is assumed.

It is moreover advantageous that the connecting and locking device is arranged on the second elevator car support part. The adjusting device advantageously serves to adjust the first elevator car support part with the first elevator car. By arranging the connecting and locking device on the second elevator car support part, the load on the adjusting device is removed as the weight of the connecting and locking device in the open state then does not act on the first elevator car support part.

A braking and/or retaining device is advantageously provided that serves to fix the second elevator car in the travel space when the first elevator car is adjusted relative to the second elevator car. The second elevator car can, for example, hereby be fixed via the second elevator car support part. It is hereby also advantageous that the braking and/or retaining device interacts with an elevator shaft and/or with a guide rail. The braking and/or retaining device for fixing the second elevator car in the travel space can thus interact with a building structure or the like. When the two elevator cars are disconnected, only the weight of the second elevator car and possibly other components connected to the second elevator car, in particular the second elevator car support, acts on the traction means. The load on the traction means is thereby removed at one end. However, the load of for example a counterweight is applied to the traction means at the other end, so that the differential force is present at the drive pulley. This means that the drive pulley must be designed accordingly, so that the second elevator car is not displaced upwards through the elevator shaft. The second elevator car can, however, be fixed by the braking and/or retaining device so that a force equilibrium is achieved.

It is also advantageous that the adjusting device is designed as a hydraulic adjusting device. As a result, inter alia, comfortable operation is enabled which is smooth and free of vibration.

It is moreover advantageous that the adjusting device is arranged in a pit of an elevator shaft and/or that the adjusting device is connected to a bottom of the elevator shaft. A simple design and advantageous alignment of the adjusting device are hereby possible. Specifically, compressive forces that occur can be reliably absorbed and a compressive force that acts in order to make adjustments can advantageously be transferred onto the first elevator car from the adjusting device.

It is moreover advantageous that the first elevator car and the second elevator car have a minimum base distance in a ready-to-travel state in which the elevator car support can be displaced through the travel space. The first elevator car can be lowered in a controlled fashion in the lower end region of the travel space, as a result of which the distance between the elevator cars increases with respect to the minimum base distance. After people have entered and left the elevator cars, the first elevator car can then be raised again until the minimum base distance between the two elevator cars has been restored.

DESCRIPTION OF THE DRAWINGS

Preferred exemplary embodiments of the invention are explained in more detail in the following description with the aid of the attached drawings, in which corresponding elements are provided with matching reference numerals. In the drawings.

DETAILED DESCRIPTION

Figure 1:
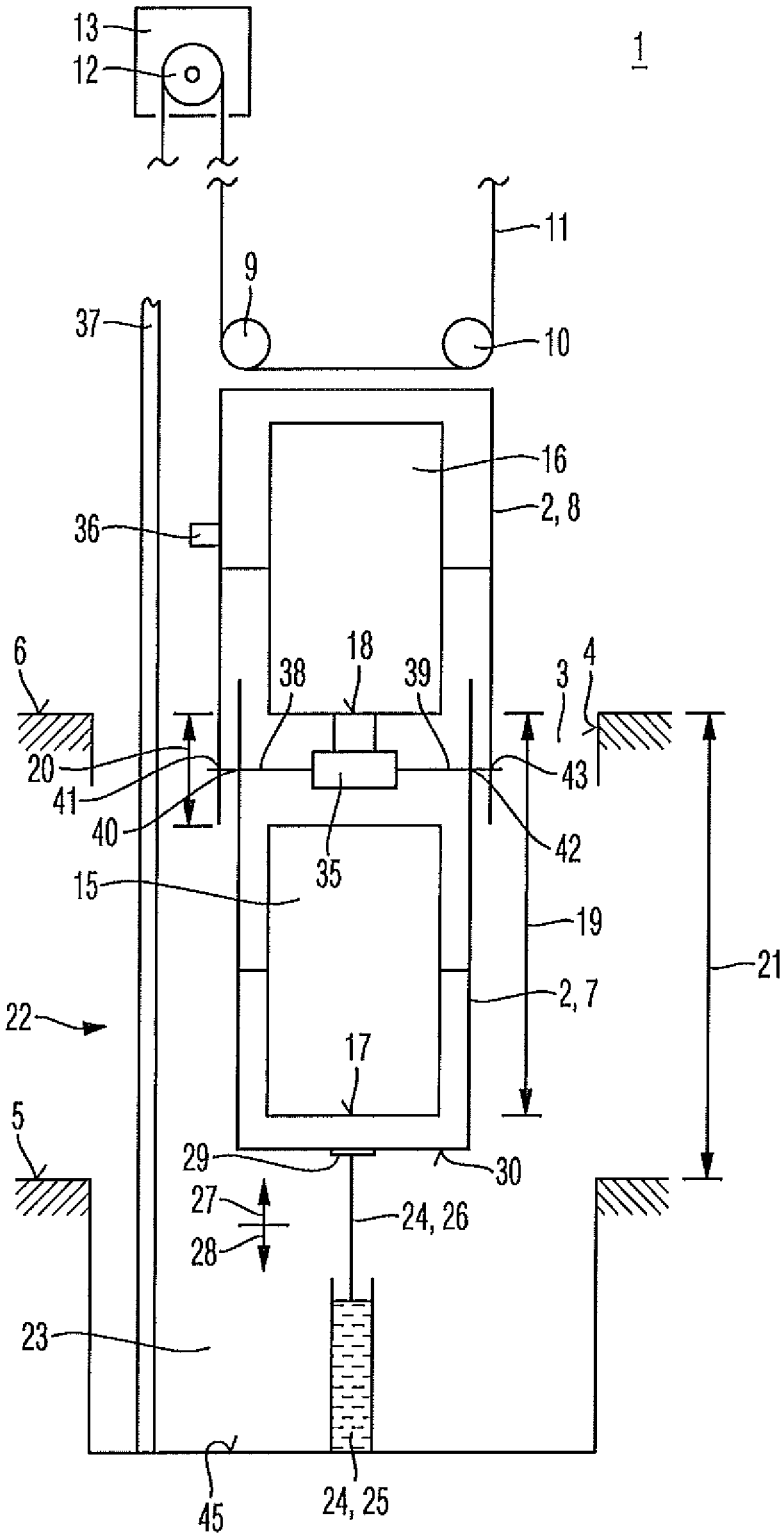
FIG. 1 shows a schematic representation of an elevator system in accordance with a first exemplary embodiment of the invention in a closed state of a connecting and locking device.

FIG. 1 shows an elevator system 1 having at least one elevator car support 2 that can be displaced in a travel space 3 provided for the travel of the elevator car support 2. The travel space 3 is provided in an elevator shaft 4 of a building. Several floors 5, 6 are provided, which represent stopping points 5, 6. The floors 5, 6 are hereby the two lowest floors of the elevator system 1. There are usually a larger number of other floors or stopping points above the floors 5, 6.

In this exemplary embodiment, the elevator car support 2 has a first elevator car support part 7 and a second elevator car support part 8. The elevator car support 2 has sheaves 9, 10 which are attached to the second elevator car support part 8. A traction means 11 is guided around the sheaves 9, 10. The traction means 11 moreover runs around a drive pulley 12 of a drive motor unit 13. According to the current direction of rotation of the drive pulley 12 driven by the drive motor unit 13, the elevator car support 2 is displaced upwards or downwards through the travel space 3. The elevator car support 2 with the two elevator car support parts 7, 8 can thus travel through the travel space 3.

The elevator car support 2 holds a first elevator car 15 and a second elevator car 16. The first elevator car 15 is hereby arranged on the first elevator car support part 7 and connected to it. Moreover, the second elevator car 16 is arranged on the second elevator car support part 8 and connected to it. The first elevator car 15 has an exit level 17. The second elevator car 16 also has an exit level 18. A distance 19 is defined between the two exit levels 17, 18. In the base position shown in FIG. 1, a minimum base distance 20 between the two elevator cars 15, 16 is provided, so that the distance 19 is also minimal. The distance 19 is hereby set to the usual distance between floors that is needed for the higher-situated floors. The distance 19 is, however, smaller than an inter-floor distance 21 between the floors 5, 6 which are the lowest floors.

In order to move to the floors 5, 6, the elevator car support 2 is moved to a lower end region 22 by corresponding actuation of the drive pulley 12 in such a way that the exit level 18 of the second elevator car 16 is positioned at the floor 6. In this position of the elevator car support 2, shown in FIG. 1, the exit level 17 of the first elevator car 15 is, however, situated above the floor 5 because the distance 19 is smaller than the inter-floor distance 21.

When the second elevator car 16 stops at the floor 6, the first elevator car 15, which is arranged in the first elevator car support part 7, is situated in the lower end region 22 of the travel space 3. The elevator shaft 4 has a pit 23 below the second elevator car support part 8. A hydraulic adjusting element 24, which has a cylinder 25 and a piston, guided in the cylinder 25, with a piston rod 26, is arranged in the pit 23. The piston rod 26 can hereby be adjusted upwards in a direction 27 or downwards in a direction 28. In the position of the elevator car support 2 which has been shown, the piston rod 26 has been adjusted upwards in the direction 27 until a plate-Vice end piece 29 connected to the piston rod 26 bears against the underside 30 of the first elevator car support part 7. The plate-like end piece 29 can hereby also already be positioned in this position so that the elevator car support 2 travels as far as the plate-like end piece 29.

The elevator system 1 has a connecting and locking device 35. The connecting and locking device 35 is arranged on the elevator car support 2. In this exemplary embodiment, the connecting and locking device 35 is arranged on the second elevator car support part 8 and connected to the second elevator car 16. Moreover, the elevator system 1 has a braking and/or retaining device 36 for the second elevator car 16. The braking and/or retaining device 36 in this exemplary embodiment is hereby connected to the second elevator car support part 8. A guide rail 37, on which the elevator car support 2 is guided in a suitable fashion, is arranged in the elevator shaft 4. Specifically, guidance during actuation by the drive motor unit 13 is ensured thereby. Moreover, the two elevator car support parts 7, 8 can each be guided independently on the guide rail 37. Further guide rails can hereby also be provided. The braking and/or retaining device 36 interacts with the guide rail 37. The braking and/or retaining device 36 hereby ensures that the second elevator car 16, which is arranged in the second elevator car support part 8, is fixed to the guide rail 37 and thus relative to the travel space 3.

The design of the elevator system 1 is described in more detail below with reference to FIG. 2.

Figure 2:
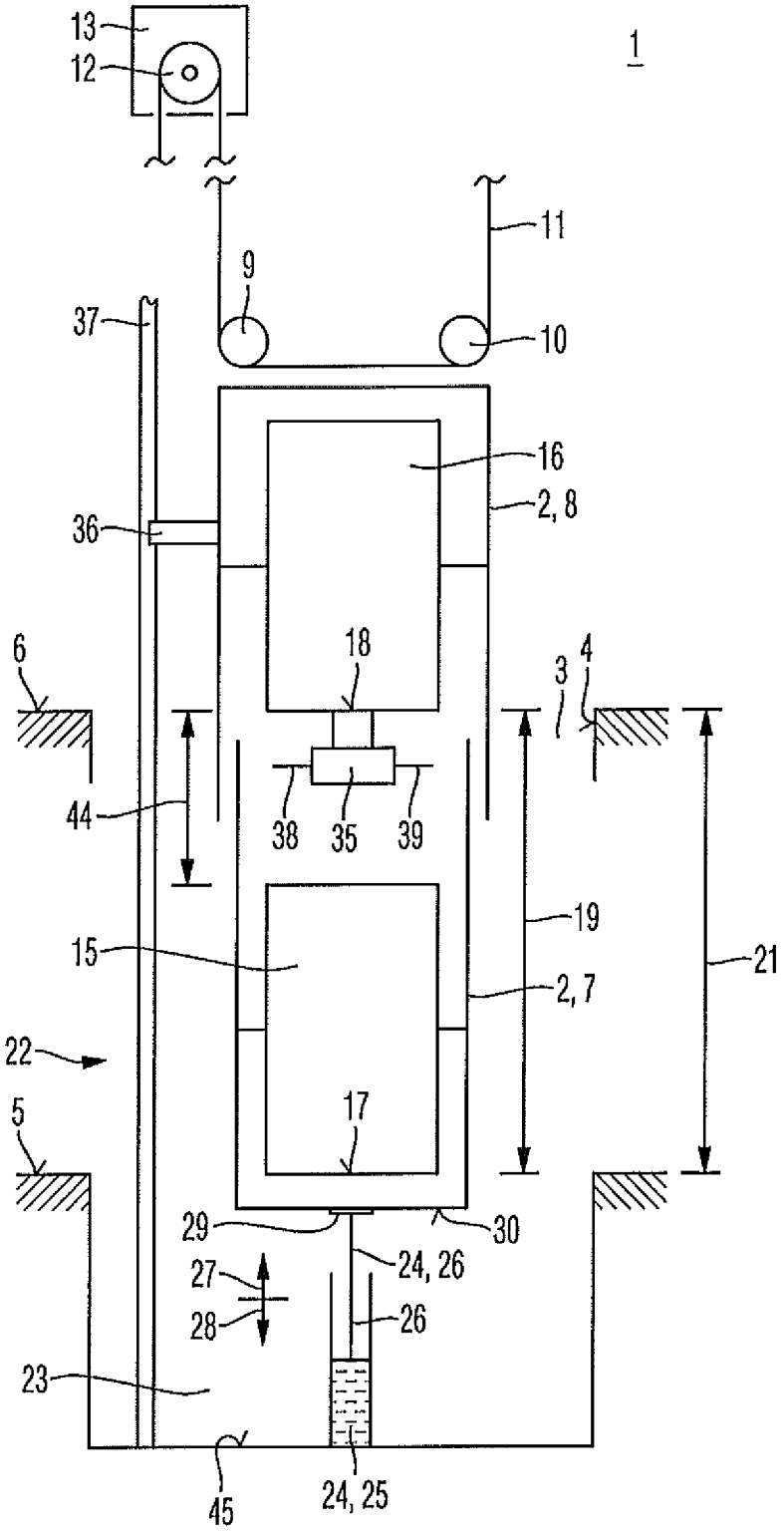
FIG. 2 shows the elevator system shown in FIG. 1 in an open state of the connecting and locking device.

FIG. 2 shows the elevator system 1 of the exemplary embodiment, when the connecting and locking device 35 is in an open state and when the braking and/or retaining device 36 is in an activated state. In contrast, FIG. 1 shows the elevator system, when the connecting and locking device 35 is in a closed state and when the braking and/or retaining device 36 is in a deactivated state.

When the first elevator car 15 is supported on the hydraulic adjusting element 24 via the first car support part 7, the braking and/or retaining device 36 is actuated, The unactuated state of the braking and/or retaining device 36 is hereby shown in FIG. 1 and the actuated state in FIG. 2. A pair of brake shoes of the braking and/or retaining device 36 hereby interacts with the guide rail 37, for example. As a result, the second elevator car support part 8 is fixed to the second elevator car 16 immovably in the travel space 3.

The connecting and locking device 35 has connecting elements 38, 39. In the closed state, the connecting elements 38, 39 are extended so that they connect the elevator car support parts 7, 8 together. The connecting element 38 hereby interacts with the first elevator car support part 7 at a connection point 40, and with the second elevator car support part 8 at a connection point 41. Through bores can, for example, hereby be provided at the connection points 40, 41 in the elevator car support parts 7, 8, into which through bores the connecting element 38 engages. In a corresponding fashion, connection points 42, 43 are also provided on the elevator car support parts 7, 8 for the connecting element 39. In the closed state, the connecting element 39 interacts with the connection points 42, 43. When the braking and/or retaining device 36 is activated, the connecting and locking device 35 is switched into the open state, the connecting elements 38, 39 being retracted. The retracted state is illustrated in FIG. 2. The elevator car support parts 7, 8 are disconnected as a result. The piston rod 26 with the plate-like end piece 29 then moves downwards in the direction 28. This is achieved by the controlled draining of a pressurized fluid from the cylinder 25. The first elevator car support part 7 hereby moves downwards with the first elevator car 15. The distance 19 hereby increases. When the distance 19 is the same as the inter-floor distance 21, the first elevator car support part 7 with the first elevator car 15 stops. The exit level 17 of the first elevator car 15 is now situated at the floor 5. A distance 44 between the elevator cars 15, 16 has hereby increased with respect to the minimum base distance 20.

In the situation shown in FIG. 2, people can enter and leave the two elevator cars 15, 16 from the respective floor 5, 6 to which they have moved. It is thus also possible for people to enter and leave the two elevator cars 15, 16 at the same time in the case of the inter-floor distance 21 which differs from the usual inter-floor distance of the other floors in the elevator shaft 4.

After people have entered and left the elevator cars 15, 16, the piston rod 26 is adjusted in the direction 27. This is achieved by feeding pressurized fluid into the cylinder 25 by means of a pump. The distance 44 hereby decreases. When the distance 44 has reached the minimum base distance 20, the connecting and locking device 35 is actuated in order to connect the two elevator car support parts 7, 8 together via the connecting elements 38, 39. The braking and/or retaining device 36 is then deactivated. The situation shown in FIG. 1 then reoccurs. The whole elevator car support 2 with the two elevator cars 15, 16 can then be displaced through the travel space 3 by the drive motor unit 13. The two elevator cars 15, 16 are then moved to their destination floors. The minimum base distance 20 between the elevator cars 15, 16 is hereby predetermined in such a way that the distance 19 then corresponds again to the usual inter-floor distance. As a result, people may also enter and leave both elevator cars 15, 16 at the same time at the other floors.

Because the connecting and locking device 35 is arranged on the second elevator car support part 8, its mass or its weight does not need to be moved or raised by the hydraulic adjusting element 24. The same applies for the braking and/or retaining device 36 attached to the second elevator car support part. As a result, the design of the hydraulic adjusting element 24 can be optimized. This also affects other components, in particular a pump. On the other hand, the hydraulic adjusting element 24 is arranged immovably in the pit 23 so that the mass of the hydraulic adjusting element 24 does not need to be moved by the drive motor unit 13.

The hydraulic adjusting element 24 is connected to a base 45 of the pit 23. As a result, forces are transmitted advantageously, because the piston rod 26 is oriented parallel to the direction in which the weight of the first elevator car support part 7 with the first elevator car 15 acts. In this exemplary embodiment, the hydraulic adjusting element 24 forms a hydraulic adjusting device 24. Depending on the design of the elevator system 1, multiple hydraulic adjusting elements 24 can also be provided for forming the hydraulic adjusting device 24.

The two elevator cars 15, 16 can thus have a minimum base distance 20 in a ready-to-travel state in which the elevator car support 2 can move through the travel space 3. In the unlocked state, in which the elevator car support parts 7, 8 are disconnected, a distance 44 between the elevator cars 15, 16 can be achieved that is greater than the minimum base distance 20. The second elevator car 16 can hereby be fixed by the braking and retaining device 36. The first elevator car 15 can be adjusted with a high degree of efficiency. The adjustment by means of the hydraulic adjusting element 24 has minimal vibration and is very smooth. A high degree of comfort is achieved as a result.

The invention is not limited to the exemplary embodiments described.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator installation has an elevator car support displaceable in a travel space provided for travel of the elevator car support, a first elevator car arranged on the elevator car support, and a second elevator car arranged on the elevator car support, comprising:

an adjusting device arranged below a lower end region of the travel space, wherein the adjusting device is a hydraulic adjusting device that includes a piston rod, a cylinder, and a pump, the piston rod configured to move in two directions by means of the pump and a pressurized fluid in the cylinder; and the first elevator car being selectively movable relative to the second elevator car, when the second elevator car is fixed in the travel space, wherein in the lower end region of the travel space the piston rod of the adjusting device engages and moves the first elevator car relative to the second elevator car in a direction of travel of the elevator car support in the travel space and the first elevator car is disengaged from the adjusting device when the first elevator car is above the lower end region of the travel space.

2. The elevator system according to claim 1 wherein the elevator car support has a first elevator car support part and a second elevator car support part movable relative to the first elevator car support part, the first elevator car being connected to the first elevator car support part and the second elevator car being connected to the second elevator car support part, and including a connecting and locking device connecting the first elevator car support part to the second elevator car support part in a closed state and disconnecting the first elevator car support part from the second elevator car support part in an open state.

3. The elevator system according to claim 2 wherein the connecting and locking device has at least one connecting element that interacts in the closed state with a connection point of at least one of the first elevator car support part and the second elevator car support part.

4. The elevator system according to claim 2 wherein the connecting and locking device is arranged on the second elevator car support part.

5. The elevator system according to claim 1 including a braking and/or retaining device positioned at the second elevator car that fixes the second elevator car in the travel space when the first elevator car is adjusted relative to the second elevator car.

6. The elevator system according to claim 5 wherein the braking and/or retaining device interacts at least one guide rail.

7. The elevator system according to claim 1 wherein the adjusting device is arranged in a pit of an elevator shaft.

8. The elevator system according to claim 1 wherein the first elevator car and the second elevator car have a minimum base distance in a ready-to-travel state in which the elevator car support can be displaced through the travel space.

9. An elevator installation comprising:

an elevator car support displaceable in a travel space provided for travel of the elevator car support, the elevator car support having a first elevator car support part and a second elevator car support part movable relative to the first elevator car support part;

a first elevator car arranged on the first elevator car support part and a second elevator car arranged on the second elevator car support part;

an adjusting device arranged below a lower end region of the travel space, wherein the adjusting device is a hydraulic adjusting device that includes a piston rod, a cylinder, and a pump, the piston rod configured to move in two directions by means of the pump and a pressurized fluid in the cylinder; and the first elevator car being selectively movable relative to the second elevator car when the second elevator car support part is fixed in the travel space and the first elevator car support part is in the lower end region of the travel space, wherein the first elevator car support part bears against the adjusting device permitting the adjusting device to move the first elevator car relative to the second elevator car in a direction of travel of the elevator car support in the travel space.

10. An elevator installation has an elevator car support displaceable in a travel space provided for travel of the elevator car support, a first elevator car arranged on the elevator car support, and a second elevator car arranged on the elevator car support above the first elevator car, comprising:

an adjusting device arranged below a lower end region of the travel space, wherein the adjusting device is a hydraulic adjusting device that includes a piston rod, a cylinder, and a pump, the piston rod configured to move in two directions by means of a pump and a pressurized fluid in the cylinder; and the first elevator car being selectively movable relative to the second elevator car, when the second elevator car is fixed in the travel space, wherein in the lower end region of the travel space the adjusting device engages and moves the first elevator car relative to the second elevator car in a direction of travel of the elevator car support in the travel space and the first elevator car is disengaged from the adjusting device when the first elevator car is above the lower end region of the travel space.

* * * * *